US008282033B2

(12) United States Patent
Achton

(10) Patent No.: US 8,282,033 B2
(45) Date of Patent: Oct. 9, 2012

(54) WEB CHANGE MECHANISM FOR A PAPER TOWEL DISPENSER

(75) Inventor: Kim Achton, Vipperod (DK)

(73) Assignee: Achton A/S, Fårevejle (DK)

( * ) Notice: Subject to any disclaimer, the term of this patent is extended or adjusted under 35 U.S.C. 154(b) by 28 days.

(21) Appl. No.: 12/966,622

(22) Filed: Dec. 13, 2010

(65) Prior Publication Data

US 2011/0133018 A1 Jun. 9, 2011

Related U.S. Application Data

(63) Continuation of application No. PCT/EP2009/057230, filed on Jun. 11, 2009.

(30) Foreign Application Priority Data

Jun. 13, 2008 (FI) ..... 20085585

(51) Int. Cl.
*B65H 19/00* (2006.01)

(52) U.S. Cl. ..... 242/560.1

(58) Field of Classification Search ..... 242/558, 242/559, 560, 560.1, 562.1, 563, 564.4
See application file for complete search history.

(56) References Cited

U.S. PATENT DOCUMENTS 3,628,743 A * 12/1971 Bastian et al. ..... 242/560.1
4,010,909 A * 3/1977 Bastian ..... 242/560.1
4,067,509 A 1/1978 Graham
4,106,684 A * 8/1978 Hartbauer et al. ..... 242/564.4
4,165,138 A 8/1979 Hedge
4,358,169 A 11/1982 Filipowicz
4,378,912 A * 4/1983 Perrin et al. ..... 242/560.1
4,756,485 A * 7/1988 Bastian et al. ..... 242/560.1
4,807,824 A 2/1989 Gains
5,302,167 A * 4/1994 Kley et al. ..... 242/560.1
5,400,982 A * 3/1995 Collins ..... 242/560
6,152,397 A * 11/2000 Purcell ..... 242/560.1
6,354,533 B1 * 3/2002 Jespersen ..... 242/560.1
6,460,798 B1 * 10/2002 Haen et al. ..... 242/560
6,474,591 B1 * 11/2002 Granger ..... 242/560

* cited by examiner

*Primary Examiner* — William A Rivera
(74) *Attorney, Agent, or Firm* — Muncy, Geissler, Olds & Lowe, PLLC

(57) ABSTRACT

The invention relates to an apparatus for dispensing web-like paper towels. The apparatus contains a dispensing accommodation for a towel paper roll, a further accommodation for the roll (1) when partly consumed, a dispensing drum (7), means (3, 4, 5) for leading the paper towel web (6) on the periphery surface of the dispensing drum (7) to a dispensing aperture (8), means (3, 4) for guiding the leading end of the towel paper web (11) from a supplementary roll (10) to a ready-to-use position for the change mechanism and a mechanism for amending the paper towel web to run from a supplemental roll when the previous roll is consumed. The change mechanism comprises a falling flap (12) supported by the web (6) coming from the partly consumed roll (1), a slide (13) impeded against a pushing force by the flap (12) and a press (14) impeded against a pushing force (A) by the slide. The press (14) guides the leading end of the web of the supplementary roll (10) to the dispensing drum (7) when the support of the towel web from the consumed roll (1) for the flap (12) ceases.

2 Claims, 2 Drawing Sheets

WEB CHANGE MECHANISM FOR A PAPER TOWEL DISPENSER

CROSS REFERENCE TO RELATED APPLICATIONS

Figure 1:
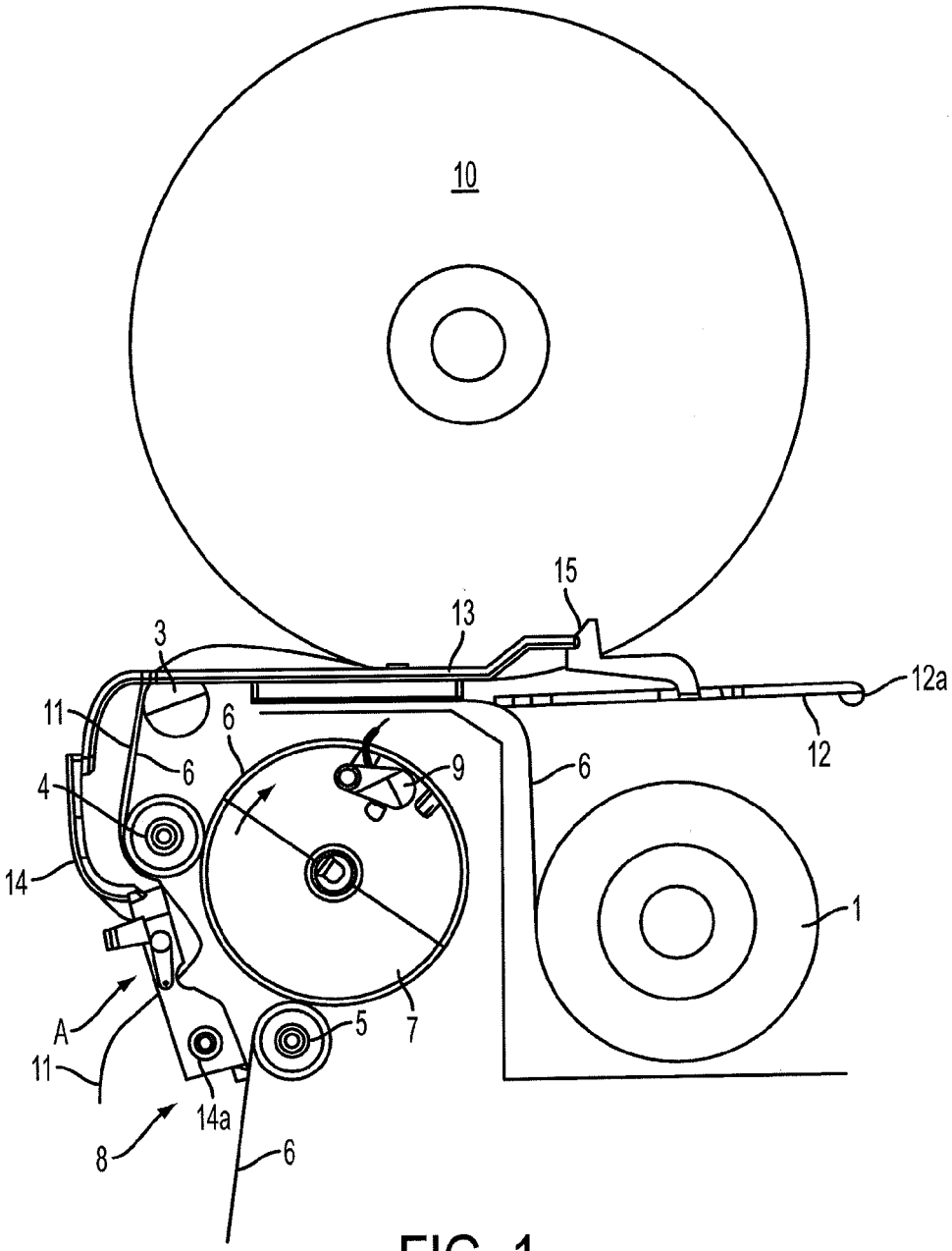

This application is a Continuation of co-pending International Application No. PCT/EP2009/057230 filed on Jun. 11, 2009, for which priority is claimed under 35 U.S.C. §120, and this application claims priority of Application No. 20085585 filed in Finland on Jun. 13, 2008 under 35 U.S.C. §119, the entire contents of all of which are hereby incorporated by reference.

The present invention relates to a mechanism for a paper towel dispenser, enabling the feeding of the web-like paper towel to proceed from a supplementary roll when there is no more paper left on an actual dispensing roll.

The dispenser is provided to contain at least two rolls, an actual dispensing roll and a supplementary roll. The supplementing service procedure of the dispenser involves a transfer of the actual dispensing roll as a residual roll to a space provided for it in the dispenser, whereby the supplemental roll takes the previous position of the residual roll. The dispensing of the paper from the residual roll from this new position is continued as long as the roll becomes empty. And when the residual roll is empty, the dispensing of the paper is transferred to be continued from the supplemental roll.

The amount of paper on a dispensing roll varies depending on how frequently the dispenser is used and may contain a considerable amount of towel paper when the dispenser is checked and serviced according to the customary supplementation schedule. It is sensible that this paper towel amount is used accurately by consumption, independently of the checking schedule.

In relevant paper towel dispensers, the paper is on the roll as a continuous web, the dispenser including a mechanism for cutting the web into fixed dispensing lengths and dispensing these successive lengths from the apparatus for use as hand towels as needed. The dispensing-cutter mechanism can be completely mechanical and manually driven by pulling out a towel sticking out of the dispenser. It is also known to use electrical dispensers for this purpose.

The basic structure and operating principles of the system for dispensing the paper towel web in the form of sheets are uniform in these apparatuses. The basic element of the system is a dispensing drum placed transversely to the web to be dispensed and having the web lying on its perimeter surface through the dispensing action. The drum is rotary and provided with devices for dispensing one towel sheet length during one turn of the drum. The diameter of the drum determines the length of the dispensed towel sheet.

The apparatus further includes leading rolls and press rolls, the latter lightly contacting the rim of the drum. The peripheral speeds of the rolls and the drum are synchronized to be substantially equal, either by free rotation of the rolls in contact with the periphery of the drum or by means of a suitable rotating mechanism. The periphery surface of the drum is usually provided with suitable friction means, as for instance roughened or covered with a friction overlay.

A blade mechanism is provided at the drum for cutting or piercing the paper web during the dispensing action. The blade mechanism is placed in an axially directed slot in the periphery of the drum, to be rotated about its own axis parallel to the axial direction of the drum. The blade mechanism includes a lever arm placed in the end of the axis thereof and having its protruding end made to follow a steady cam surface positioned on the inner wall of the dispenser house. By following this cam surface, the lever arm turns the cutting blade around its axle with respect to the actual rotational position of the drum. Within a given rotational angle range of the dispensing drum, the blade protrudes from the periphery of the drum, within a given range it is positioned below the periphery surface of the drum. The cutting edge of the blade is serrated, i.e. the blade gradually penetrates into the web by means of its triangular teeth, a full cutting effect being achieved in a rotational position of the drum, where the blade is turned to project completely out.

The web to be dispensed sits tight on the periphery surface of the dispensing drum due to the pulling effect from the user, which effect can be enhanced by a braking effect from possible guide rolls.

When a towel dispenser is serviced, there usually are, if the amount of use of the dispenser and the supplementation service schedule are reasonably synchronized, an almost completely emptied towel web roll at the dispensing position and the core as well as the end pins of an emptied residual roll in the space provided for the roll and used in the previous servicing. The residual roll space is cleared and the actual, partly consumed dispensing roll is moved to this space. It should be possible to perform this transfering step without interrupting the dispensing state of the paper web on the dispensing drum. A completely new supplementary roll is supplied into the previous position of the partly consumed dispensing roll, whereby the partly consumed roll continues the dispensing as a residual roll. The leading end of the web on the supplementary roll is passed to a ready-to-use position in the front part of the dispenser from where the change mechanism can push it onto the dispensing drum when there is no more paper left on the residual dispensing roll.

Figure 2:
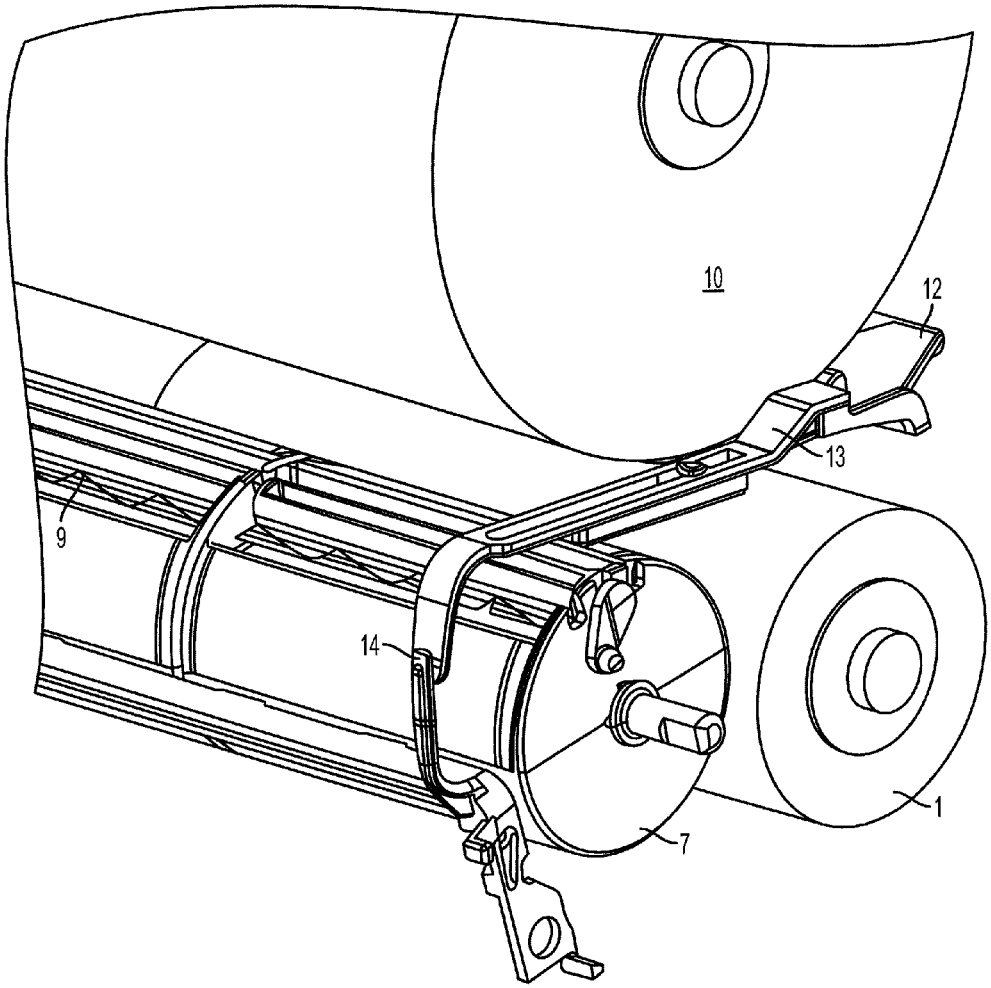

The invention will be explained in more detail with reference to the accompanying drawing in which FIG. 1 is a schematic view of the basic parts of a paper towel dispenser according to the invention, and FIG. 2 shows the substantially same basic parts seen from a different angle.

FIG. 1 shows a paper towel dispenser working on the conventional principle. The dispenser is in a situation in which it has just been subjected to a supplementation service. During the supplementation service, a paper towel web roll 1 being partly consumed at a dispensing station in the upper part of the apparatus was removed to a residual roll position, but keeping the paper web 6 ready to be continued from this roll. A full towel paper web roll 10 was placed in the upper part of the apparatus, having the front end of the web 11 led to a ready-to-use position from which the web change mechanism can feed it for dispensing.

The apparatus includes, as a basic part, a dispensing drum 7 having the paper web 6 to be dispensed running on its periphery surface and extending from a dispensing aperture, cut or pierced into certain lengths. As the paper web runs, it is guided by a guiding roll 3 as well as press rolls 4 and 5. The latter are in a light pressing contact with the periphery surface of the dispensing drum. As described above, a cutting blade 9 is placed on the dispensing drum, protruding from the periphery surface of the drum 7 along a given segment of the turn of the dispensing drum, penetrates through the paper 6 on the drum and cut-perforates it.

The change mechanism for replacing the web 6 with the web 11 on the drum 7 in a situation in which the web 6 no longer runs from the residual dispensing roll 1, comprises several members operating together. First, it comprises a flap 12 descending under the incluence of gravity and connected to the house of the apparatus by a hinge 12*a*. In operation, the flap 12 is in a substantially horizontal position. The flap 12 is supported in this position in its protruding end by the paper towel web 6 running from the residual dispensing roll 1 to the dispensing drum 7. The flap 12 is provided with a stopper 15. A substantially horizontal slide 13 is leaning against the stopper under a spring load. The spring load on the slide 13 is transmitted from a press 14 affected by an appropriate pressing spring in the direction of arrow A, trying to turn the press 14 around its fixing point towards the dispensing roll 7. The slide 13 prevents this turning movement as long as it lies against the stopper 15 of the flap 12.

When the dispenser is loaded, the front end of the web 11 of the supplementary roll 10 is passed into range of influence of the press 14, into the space between the press and the dispensing drum. In this configuration, when the residual dispensing roll 1 becomes empty and the web 6 is no longer running, the protruding end of the flap 12 falls down under the influence of gravity. This falling down releases the slide 13 from the stopper 15, the slide then being able to slide, pushed by the press 14 and the spring force A, towards the hinge point 12*a* of the flap 12. Likewise, the press 14 moves towards the dispensing drum and takes the leading end of the web 11 of supplementary roll 10 to the roughened surface of the dispensing drum 7. The web then runs on the periphery of the drum further when a consumer draws the rest of the web 6 and causes thereby the drum to rotate under this tensioning effect.

The flap 12 must be capable of turning up on the hinge 12*a* so that the partly consumed roll from dispensing position can be removed to the residual roll station without problems and without changing the situation for the paper web 6 being unwound from the roll.

The dispensing drum 7 in the towel dispenser is provided with an eccentric spring-load controlling the rotation of the drum. The load is activated as the drum rotates half a turn and which similarly releases its activation energy during the next half-turn. This arrangement gives the dispenser a simple function to rotate the drum 7 around a full turn for each dispensed towel.

The web change mechanism according to the invention can also be implemented in towel dispensers which do not have the above-described towel web cutting mechanism on the dispensing drum, but the cutting is performed by a tearing motion at the dispensing aperture 8.

The invention claimed is:

1. An apparatus for dispensing towel paper comprising:

a first accommodation for a roll of a towel paper to be dispensed, a second accommodation for the roll when essentially consumed, a dispensing drum for delivering the towel paper in determined lengths, means for leading the towel paper on the periphery of the dispensing drum to a dispensing aperture for disposal of a consumer, a mechanism for changing the path of the towel paper from a consumed roll in the second accommodation to run from a roll supplemented into the first accommodation, including a falling flap supported by the paper towel web running from the partly consumed roll in the second accommodation, a slide impeded against a pushing force by the flap and a press impeded against a spring actuated pushing force by the slide, which press guides the leading end of the web of the supplementary roll to the dispensing drum when the support of the paper towel web for the flap from the consumed roll ceases.

2. A change mechanism as defined in claim 1, wherein the flap can be turned up on a hinge for changing the position of a partly consumed paper towel web roll from the first accommodation to the second accommodation.

* * * * *